United States Patent [19]

Stange

[11] 4,014,537

[45] Mar. 29, 1977

[54] AIR FLOATATION BOTTOM FEEDER

[75] Inventor: Klaus K. Stange, Pittsford, N.Y.

[73] Assignee: Xerox Corporation, Stamford, Conn.

[22] Filed: Nov. 28, 1975

[21] Appl. No.: 636,015

[52] U.S. Cl. ..... 271/166; 271/35; 271/105; 271/171

[51] Int. Cl.[2] ..... B65H 3/04; B65H 3/48

[58] Field of Search ..... 271/35, 34, 105, 166, 271/165, 98, 97, 171, 134, 144

[56] References Cited

UNITED STATES PATENTS

| | | | |
|---|---|---|---|
| 1,710,706 | 4/1929 | Maxner | 271/105 |
| 2,011,464 | 8/1935 | Winkler et al. | 271/98 |
| 3,212,772 | 10/1965 | Ward | 271/35 X |
| 3,262,697 | 7/1966 | Krinke | 271/35 X |
| 3,934,869 | 1/1976 | Strobel | 271/35 |
| 3,936,044 | 2/1976 | Kramer | 271/171 X |

*Primary Examiner*—Johnny D. Cherry
*Assistant Examiner*—Bruce H. Stoner, Jr.

[57] ABSTRACT

A sheet feeding device adapted for feeding sheets individually from the bottom of a stack of sheets. An air floatation stacking tray is provided to minimize sheet-to-tray and inter-sheet friction to assure positive feeding of individual sheets from the bottom of the stack irrespective of stack height.

5 Claims, 2 Drawing Figures

AIR FLOATATION BOTTOM FEEDER

BACKGROUND OF THE INVENTION

In modern high speed sheet processing machines such as xerographic systems, a sheet misfeed or multi-fed sheets can seriously impair the operation of the machine. Numerous devices of the type disclosed in U.S. Pat. No. 3,768,803 have been employed to minimize the possibility of misfeeds and multi-feeds.

To provide a constant normal force between the sheet being fed and the feed mechanism, it is common practice to employ a sheet elevator tray assembly having sheets stacked thereon, the feed mechanism being disposed above the stack for feeding the top sheet from the stack. As sheets are fed from the stack, the elevator is continuously shifted in an upward direction to maintain the top sheet in the stack adjacent the feed mechanism. This type of feeder is ordinarily used when a varying quantity of sheets may be loaded into the sheet tray since it has heretofore been very difficult to provide a dependable bottom sheet feed device due to the constantly varying weight of sheets in the tray which must be handled if a bottom sheet feed device is used. While it is more desirable and more convenient to use a bottom feed device since the sheet stack may be replenished without stopping machine operation and the complex elevator mechanism may be eliminated, the poor paper feeding capabilities of bottom feed devices has prevented common acceptance thereof. In U.S. Pat. Nos. 1,945,527 and 1,945,248 (Winkler), it is suggested that an air cushion stack levitation device be utilized to provide accurate, dependable bottom sheet feeding. U.S. Pat. No. 2,806,696 (Bishop) suggests the use of "riffle air" to help separate and lift the stack from the bottom sheets. However, in attempting to build a bottom sheet feeder in accordance with the teachings of the aforementioned patents it is soon apparent that the construction of a bottom air floatation feeder is not as simple as the patents would suggest.

It is therefore an object of the present invention to provide an improved air floatation stacking tray adapted for supporting a stack of sheets therein to enable consistent, accurate feeding of single sheets from the bottom of the stack with minimal possibilities of multi-feeds and misfeeds.

SUMMARY OF THE INVENTION

The subject invention relates to a bottom sheet feed device employing an air floatation stack tray having a plurality of fine bore, square edged apertures therein adapted to provide a plurality of fine air streams or jets for contact with, and percolation through, the bottom sheets in a stack of sheets to minimize inter-sheet frictional resistence to the feeding of the bottom sheet from the stack. Adjustable side guides are provided to allow the stack tray to accommodate various sheet dimensions while preventing escape of air from the tray perforations in those areas of the tray which are not directly under the sheet stack irrespective of the adjustment of the side guides.

DESCRIPTION OF THE PREFERRED EMBODIMENT

Figure 1:
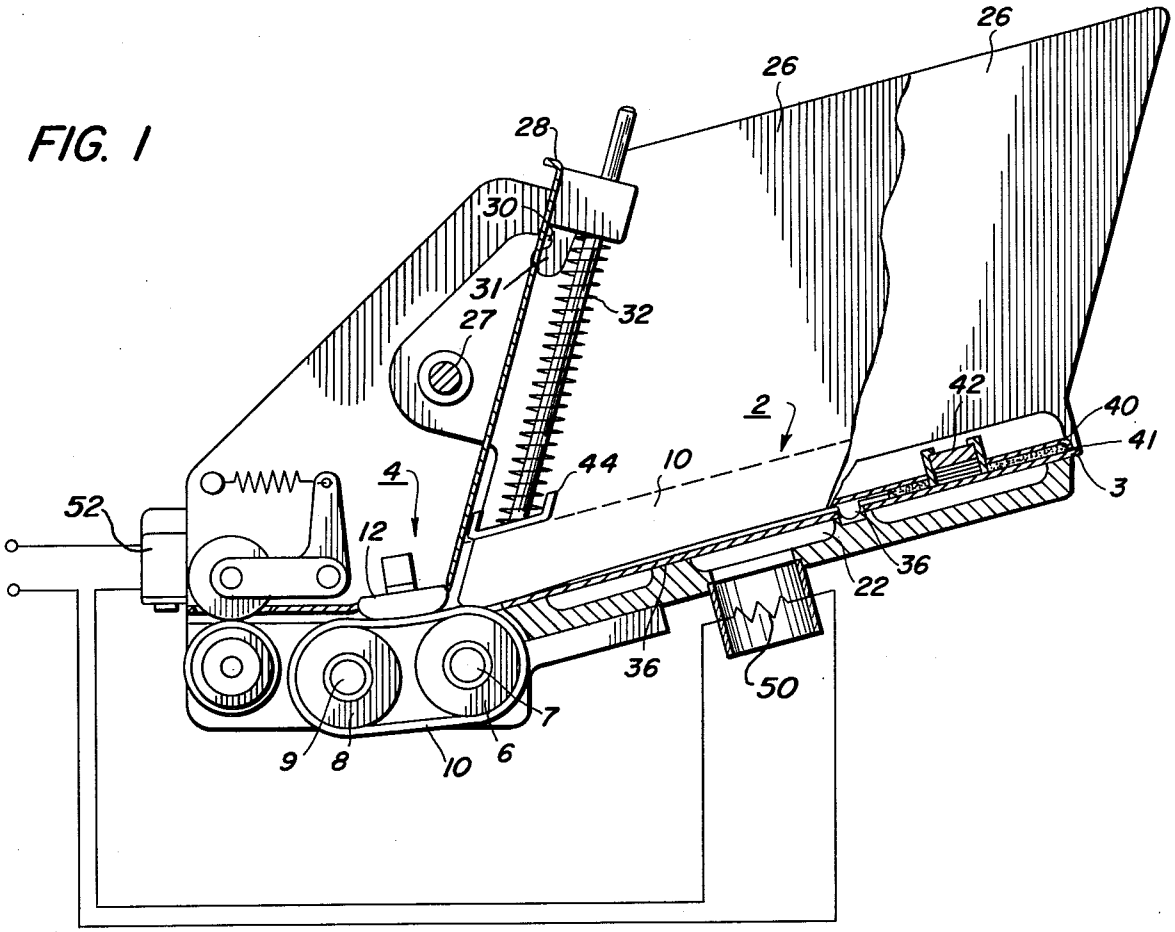
FIG. 1 is a side view in section of the preferred embodiment of the present invention.

Referring to the drawings, the sheet feeding apparatus of the present invention includes a sheet supply tray 2 having a perforated sheet support plate 3 preferably formed of a ferrous metal and a sheet separation apparatus 4. The sheet separation apparatus 4 is comprised of rolls 6 and 8 having a belt 10 mounted thereon. The belt is formed of a suitable non-stretch high friction material such as rubber impregnated fabric.

Rolls 6 and 8 are mounted on stationary axes 7 and 9 respectively to maintain the desired spacial relationship between the edge of the paper stack 10, an abutment type retard pad 12, and the upper surface of tray assembly 2. For a complete description of the relationship between a feed belt, and abutment type retard means and the sheets stacked on the tray assembly 2, reference may be had to U.S. Pat. No. 3,768,803, commonly assigned to the assignee of the present application.

Roll 8 may be driven by a motor-clutch mechanism 14, the motor preferably being constantly energized, the clutch associated therewith being activated by a suitable feed signal whenever a sheet is to be fed by the sheet separation apparatus 4.

A plenum 22, adapted to receive a pressurized fluid such as air from a suitable source (not shown) is formed beneath the bottom surface of sheet support plate 3, perforations 24 being provided in plate 3 for passage of the pressurized fluid therethrough. The size and design of perforations 24 is very critical. Preferably, the perforations comprise fine bores having a diameter ranging between 15 to 35 mils. Bores below that range are difficult to manufacture and would require filtered air to prevent clogging. Larger bores would not produce the desired "jets" of air required for optimum performance. The top edge of the bores are square-edged, i.e., not chamfered or in any way broken, as it is desired to have sharp edged orifices formed in the plate to provide distinct jets of air for maximum air penetration through the bottom sheets stacked on the plate and thereby provide a cushion of air between the bottom sheet and the sheets thereabove. In passing through the bottom sheet, the air will be diffused by the paper fibers and thereby provide a more generalized flow of air between the bottom sheet and the sheet thereabove as contrasted to the air jets to which the bottom sheet in the stack is subjected.

Figure 2:
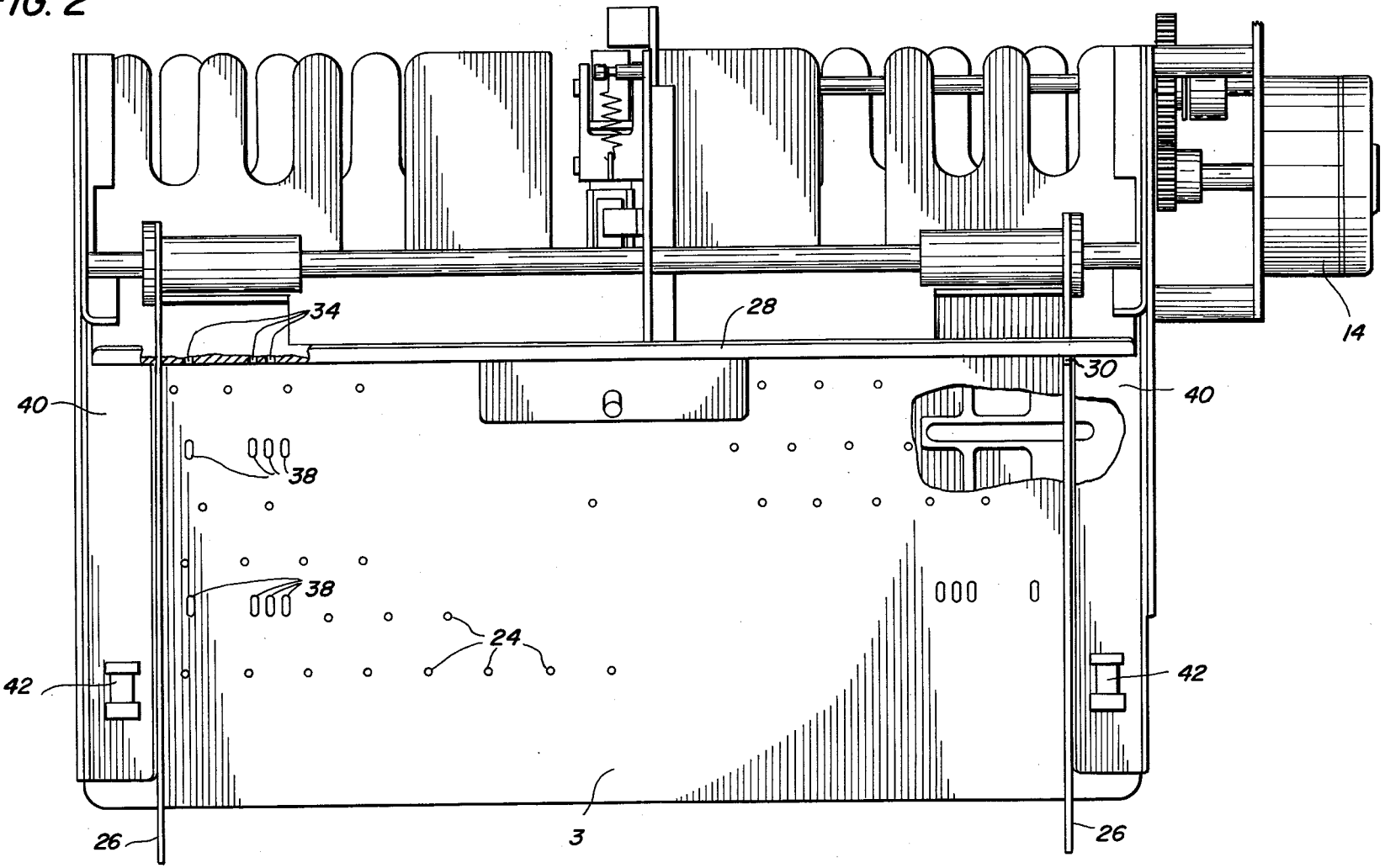
FIG. 2 is a plan view of the apparatus of FIG. 1 with the sheet stack removed to illustrate the perforations in the stack trays for passage of air therethrough.

By reference to FIG. 2, it can be seen that the tray assembly is provided with side guides 26 and a front edge abutment plate 28. The side guides 26 are mounted for sliding and pivotal motion on a side guide bar 27. Rearwardly facing tabs 30 formed in clearance recess 31 on each side guide 26 are provided for mating engagement with one of a plurality of slots 34 formed in abutment plate 28. Projecting tabs 36 formed along the bottom edge of each side guide are adapted for engagement in one set of a plurality of blind slots 38 formed in the perforated plate 3. By lifting the rear portion of each side guide 26, the front projection and bottom tabs are displaced from their respective slots in abutment plate 28 and perforated plate 3 to enable the side guide to be slid along guide bar 27 to adjust the position of the side guides. The plurality of slots 34 and 38 are provided in the abutment plate 28 and perforated plate 3 to enable adjustment of the side guides to accept commonly encountered sheet sizes, for example, 8½ by 11, 8½ by 13, and 8½ by 14 inch paper.

By reference to FIGS. 1 and 2 it can also be seen that the side guides are provided with projecting flanges 40 which project outwardly over the perforated plate 3. The flanges are formed on side guides 26 in such a location that they are spaced from the perforated plate 3 when the side guides are in their adjusted position. Sealing material, such as foam strips 41, is provided around the outer edges of the flanges to prevent escape of air from the forward, rear, and outer edges of the side guides. Magnets 42 are mounted on flanges 40 to hold the flanges and associated side guides 26 against plate 3.

It can be seen by reference to FIG. 1 that the bottom surface of each of the side guides 26 is not completely flat but is concave to provide space between the bottom edge of the side guide and the perforated plate 3. Thus, air escaping from the perforations in the plate 3 beneath flanges 40, which air is not allowed to escape outwardly due to the sealing material on the flanges, is forced inwardly under the side guides 26 to provide side riffle air to the stacked sheets to more positively separate the bottom sheet in the stack from the sheets immediately thereabove for improved sheet separation.

For automatic positioning of the sheets in the stack against the perforated plates, it is desirable to have plate 3 slanted downwardly in the feed direction while the abutment plate 28 is slanted rearwardly to provide an acute angle between the abutment plate and the perforated bottom plate. The forward slant of the perforated plate taken in conjunction with the air floatation effect, causes the lower sheets in the stack to slide or move toward the front abutment plate while the rearwardly slanting abutment plate causes the sheets in the stack to effect a "wedging" action upon the lower sheet in the stack to assure adequate normal force against the sheet being fed for proper frictional engagement with the feed belt 10 and to prevent air from escaping from the lead edge of the bottom sheets in the stack.

In the event problems are encountered in feeding the sheets with the disclosed device due to insufficient normal force against the sheets in the stack, it may be desirable to provide a sheet holddown device for pressing the sheets against the feed belt.

While any number of devices may be utilized for pressing the sheets in the stack against the feed belt, in the disclosed embodiment there is illustrated a spring biased presser foot 44. Due to the normal spring constant of spring 32, as more sheets are loaded into the tray a greater force is exerted against the sheets in the stack since the spring is compressed to a greater degree. While this would at the outset appear to be opposite to the desired force relationship since the bottom sheets in the stack would ordinarily be considered as having the entire weight of the sheet stack pressed thereagainst which would provide an increased weight as the stack height is increased, in practice it has been found that as the stack height increases, the slight curvature of the sheets and/or the beam strength thereof actually causes a "bridging" action upon the sheets, minimizing the normal force against the bottom sheet in the stack and thereby providing insufficient force against the feed belt. Thus, to assure adequate force against the feed belt and to overcome the increased beam strength of the paper as the stack height increases, it may be necessary to provide a presser foot wherein the normal force against the stack increases as the stack height increases.

In the event the printing machine with which the subject feeder may be utilized is humidity sensitive, i.e., produces degraded copies when the copy sheets have a moisture content above a certain level as is common in xerographic reproduction machines, sheet moisture content control may be incorporated in the disclosed sheet feeder. By reference to the drawings, it can be seen that a heating element 50 disposed in the air supply path leading to the air plenum 22 is operatively connected to a sheet humidity or moisture sensor 52 which is adapted to sense the moisture content of sheets passing thereunder. In the event the moisture content is above the desired level, the sensor will energize heater 50 to heat the air passing into plenum 22. Since the jets of air from plenum 22 percolate through the paper fibers, extremely rapid moisture removal from the sheets is possible.

From the foregoing, it can be seen that a bottom air floatation feeder has been provided which is easily adjustable for various size paper, prevents excape of air from the air floatation plate when the side guides are adjusted for minimal sized paper, provides for air riffling along the sides of the sheet for improved paper separation, controls the moisture content of the paper, and maximizes air percolation through the bottom sheet in the stack to provide an air cushion between the bottom sheet and the next sheet thereabove in the stack to assure that the beneficial features of air floatation affect only the bottom sheets in the stack to minimize mis-feeds and multi-feeds and therefore provide a trouble-free, dependable bottom sheet feeder.

While the invention has been described with reference to the structure disclosed, it is not confined to the details set forth, but is intended to cover such modifications or changes as may come within the scope of the following claims.

What is claimed is:

1. A sheet feeding device adapted for feeding sheets individually from the bottom of the stack of sheets comprising:

means forming an air plenum adapted for connection to a source of pressurized air, a sheet support plate associated with said plenum, said sheet support plate having a plurality of fine bores formed therein adapted for communication with the interior of said air plenum for passage of air from said air plenum through said bores, said bores terminating at the sheet support surface of said plate in sharp edged orifices, passage of air from said plenum through said bores producing jets of air adapted for penetration through the bottom sheet in the stack, passage of air through the bottom sheet in the stack causing the air jets to be diffused to provide an air cushion between the bottom sheet in the stack and the sheets immediately thereabove;

sheet feeding means mounted adjacent said sheet support plate adapted for contact with the bottom sheet in the stack for feeding the bottom sheet therefrom;

a front edge abutment plate associated with said sheet support plate, said abutment plate being spaced from said sheet support plate to allow passage of sheets separated from the stack to pass beneath said abutment plate;

adjustable side guides adapted for cooperation with said abutment plate and said sheet support plate, said side guides being adjustable to a plurality of positions to accommodate a plurality of sheet stack sizes, said side guides having outwardly projecting flanges thereon overlying said sheet support plate, the outer periphery of the lower surface of said flanges having sealing material attached thereto to provide fluid tight engagement between said flanges and said perforated plate, said side guides being formed to provide a space between the lower edge of the side guides and said sheet support plate, air passing through the bores in said sheet support plate beneath said flanges escaping from beneath said side guides into the sheet stack on said sheet support plate for riffling the lower sheets in the stack to increase the air cushion effect between the lower sheets in the stack.

2. A sheet feeding device according to claim 1 further including a sheet holddown device adapted to provide a biasing force against the top of the sheet stack to force the bottom sheet in the stack against said sheet feeding means, said holddown device being adapted to provide decreasing biasing force as the height of the stack decreases.

3. A sheet handling device according to claim 1 further including a side guide bar mounted parallel to, and in front of, said abutment plate, each of said side guides having a forward projection thereon adapted for pivotal and sliding engagement with said side guide bar, said abutment plate having openings therein for passage therethrough of said side guides, said forward projections of said side guides each having a rearwardly projecting tab formed thereon, said abutment plate having a plurality of slots formed therein, pivotal movement of said side guides about said side guide bar away from said sheet support plate causing said tabs to be disengaged from the slots in said abutment plate for movement of said side guides axially along said rod to adjust the position of said side guides, pivotal movement of each side guide into engagement with said sheet support plate causing the tab thereon to project into one of the slots in said abutment plate to prevent further sideward movement of said side guide relative to said side guide bar.

4. A sheet feeding device according to claim 3 wherein said side guides further include downwardly projecting tabs thereon, said sheet support plate having blind holes formed therein adapted for receipt of said downwardly projecting tabs, pivotal movement of said side guides away from said sheet support plate causing said tabs to be disengaged from said blind holes to enable axial sliding of said side guides on said side guide rod for adjustment of said side guides, movement of said side guides into engagement with said sheet support plate causing said tabs to project into said blind holes to prevent further sideward motion of said side guides.

5. A sheet feeding device according to claim 4 wherein said sheet support plate is formed of a ferrous metal, said outwardly projecting flanges having magnetic means attached thereto to magnetically clamp said side guides against said sheet support plate.

* * * * *